US006161624A

United States Patent [19]

Bennett

[11] Patent Number: 6,161,624

[45] Date of Patent: Dec. 19, 2000

[54] LINEAR FIRE EXTINGUISHER

[75] Inventor: Joseph M. Bennett, Huber Heights, Ohio

[73] Assignee: The United States of America as represented by the Secretary of the Air Force, Washington, D.C.

[21] Appl. No.: 09/450,046

[22] Filed: Nov. 29, 1999

[51] Int. Cl.[7] ..... A62C 37/14

[52] U.S. Cl. ..... 169/58; 169/62

[58] Field of Search ..... 169/58, 62, 57, 169/35, 26, 51

[56] References Cited

U.S. PATENT DOCUMENTS

| | | |
|---|---|---|
| H141 | 10/1986 | Finnerty et al. . |
| 2,382,120 | 8/1945 | White . |
| 3,326,295 | 6/1967 | Kataoka . |
| 3,486,563 | 12/1969 | Cholin et al. . |
| 3,827,502 | 8/1974 | Lockwook . |

*Primary Examiner*—Andres Kashnikow
*Assistant Examiner*—Christopher S. Kim
*Attorney, Agent, or Firm*—Bobby D. Scearce; Thomas L. Kundert

[57] ABSTRACT

A linear fire extinguisher system is described that includes a flexible, substantially closed plastic tube containing an extinguishant, the tube containing a multiplicity of selectively weakened pre-scored orifices at preselected spacing along the tube length, whereby sufficient heat from a fire contacting the tube will weaken and rupture the tube predictably and facilitate efficient discharge of the extinguishant directly onto the fire. The structure of the invention may include two coaxial inner and outer tubes, each tube containing extinguishant wherein the outer tube may initially rupture upon heating and discharge extinguishant onto the fire, the inner tube being available for rupture and discharge onto the fire upon re-ignition or if the discharge of the outer tube is insufficient to extinguish the fire.

6 Claims, 2 Drawing Sheets

LINEAR FIRE EXTINGUISHER

RIGHTS OF THE GOVERNMENT

The invention described herein may be manufactured and used by or for the Government of the United States for all governmental purposes without the payment of any royalty.

BACKGROUND OF THE INVENTION

The present invention relates generally to fire extinguishment systems and methods, and more particularly to an improved linear fire extinguisher system.

Linear fire extinguishment systems have been described in the prior art as useful for fire suppression in substantially closed spaces, such as vehicle engine compartments, aircraft engine nacelles, closed fuel storage areas, and the like. The prior art systems may be exemplified by that taught by Stewart et al (U.S. Pat. No. 5,909,776), and the references cited therein, which disclose a linear type fire extinguisher system including a sealed flexible plastic tube pressurized with gaseous extinguishant. The tube is routed in serpentine fashion throughout the compartment zone(s) to be protected from fire. When a fire on or near the protected compartment impinges on and locally heats a portion of the tube, the plastic weakens and ruptures at the heated portion and discharges the contents of the tube through the rupture onto the fire. Extinguishant discharge directly on the fire at its point of origin in the protected compartment is intended so that the amount of extinguishant available for discharge is efficiently used and storage of a quantity of extinguishant sufficient to flood the entire volume of the protected compartment is not necessary. The linear fire extinguisher structure is therefore useful in space critical applications such as vehicle engine compartments and aircraft engine nacelles. Because the linear extinguisher tube structure may be routed throughout very cluttered and widely spaced protected zones, the linear extinguisher may function as a fire detection system, an extinguishant reservoir and a discharge network in a single operationally reliable and cost and weight efficient system.

Prior art linear extinguisher structures suffer certain operational limitations principally because the tubes lack structure that would rupture predictably in response to the application of heat from a fire. Unsuccessful extinguishant discharge often results under some fire scenarios because of erratic tube rupture by splitting or cracking and subsequent inadequate, erratic and unpredictable extinguishant flow from the tube. After tube rupture, the extinguishant discharges substantially completely over a brief period of time, so if a persistent ignition source remains, such as a hot surface and residual combustible fluid, the fire may re-ignite after initial extinguishment.

The invention solves or substantially reduces in critical importance problems in the prior art as just described by providing an improved linear fire extinguisher structure including a plastic tube for containing and discharging extinguishant upon rupture of the tube, the tube having a multiplicity of selectively weakened pre-scored orifice patterns in the tube wall, the scored patterns having sufficient depth into the wall thickness to ensure preferential rupture at a scored pattern on heating, but without causing undesirable and premature discharge at heating temperatures or extinguishant pressures below predetermined desired threshold values. The invention also includes a coaxial tube structure in which an inner tube containing extinguishant is disposed within a second outer tube also containing extinguishant in the space between the inner and outer tubes, and wherein at least one of the inner and outer tube include a multiplicity of selectively weakened pre-scored orifice patterns, the outer tube initially rupturing and discharging extinguishant upon heating to initially extinguish the fire, and if the fire is not extinguished (or re-ignites) after initial discharge by the outer tube, the inner tube provides back-up linear extinguisher capability for the protected compartment(s). After thermal-induced rupture of the outer tube, residual extinguishant between the tubes may provide coolant to the inner tube to prevent premature rupture thereof.

The invention finds utility within substantially any enclosure where a fire may originate, and is especially useful in providing fire extinguishment capability in machinery enclosure applications where space is limited, such as aircraft engine nacelles, aircraft auxiliary power units and ground support equipment, vehicle engine compartments, ship engine or other machinery compartments, stationary turbines and other stationary power equipment, power equipment trailers and industrial machinery applications where liquid-fueled, oiled or hydraulically controlled equipment is operated.

It is therefore a principal object of the invention to provide an improved linear fire extinguisher system.

It is another object of the invention to provide a linear fire extinguisher having structure that ruptures predictably along its length upon the application of heat.

It is yet another object of the invention to provide a compact, light weight and inexpensive fire extinguisher system.

It is yet another object of the invention to provide a linear fire extinguisher system that ruptures and discharges extinguishant efficiently and reliably.

It is a further object of the invention to provide a linear fire extinguisher system with second time extinguishment capability in case of fire re-ignition.

These and other objects of the invention will become apparent as a detailed description of representative embodiments proceeds.

SUMMARY OF THE INVENTION

In accordance with the foregoing principles and objects of the invention, a linear fire extinguisher system is described that includes a flexible, substantially closed plastic tube containing an extinguishant, the tube containing a multiplicity of selectively weakened pre-scored orifices at preselected spacing along the tube length, whereby sufficient heat from a fire contacting the tube will weaken and rupture the tube predictably and facilitate efficient discharge of the extinguishant directly onto the fire. The structure of the invention may include two coaxial inner and outer tubes, each tube containing extinguishant wherein the outer tube may initially rupture upon heating and discharge extinguishant onto the fire, the inner tube being available for rupture and discharge onto the fire upon re-ignition or if the discharge of the outer tube is insufficient to extinguish the fire.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
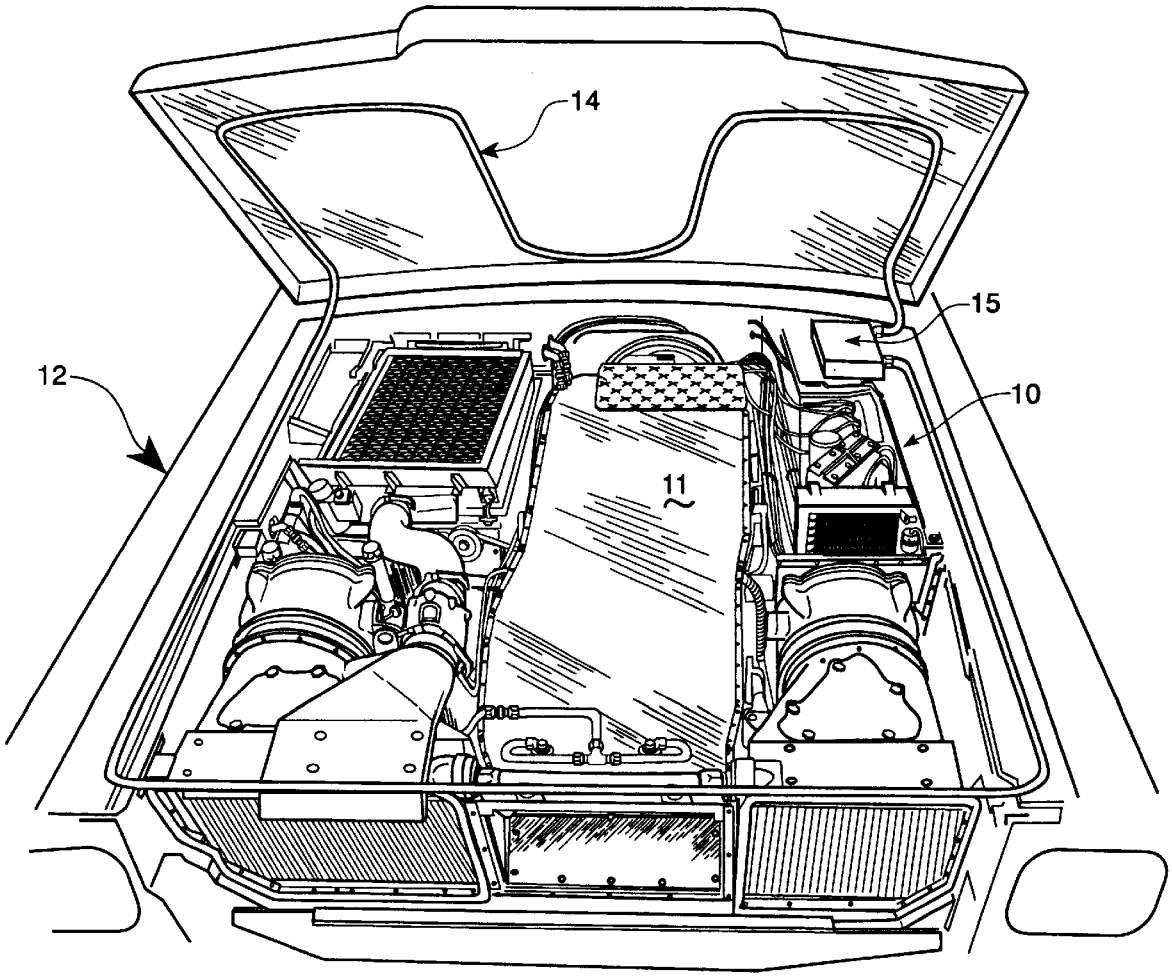
FIG. 1 illustrates an automotive engine compartment with a linear fire extinguisher system in place for protecting the engine from fire within the engine compartment.

Referring now to the drawings, FIG. 1 is a schematic illustration of a compartment 10 for an automotive engine 11 within a vehicle 12 representative of the enclosures for hot operating machinery in which the invention may be useful. In accordance with the operating principles of the linear fire extinguisher structure of the invention, a substantially closed tube 14 containing extinguishant may be operatively connected to an optional source 15 of extinguishant and routed in any selected configuration throughout compartment 10 in order to provide fire protection for engine 11 as elsewhere described herein. Tube 14 may ordinarily have length and volume sufficient to contain an amount of extinguishant required to extinguish a fire, and, accordingly, a separate source 15 of extinguishant would generally not be required, which is an advantage of the linear fire extinguisher system generally.

Figure 2:
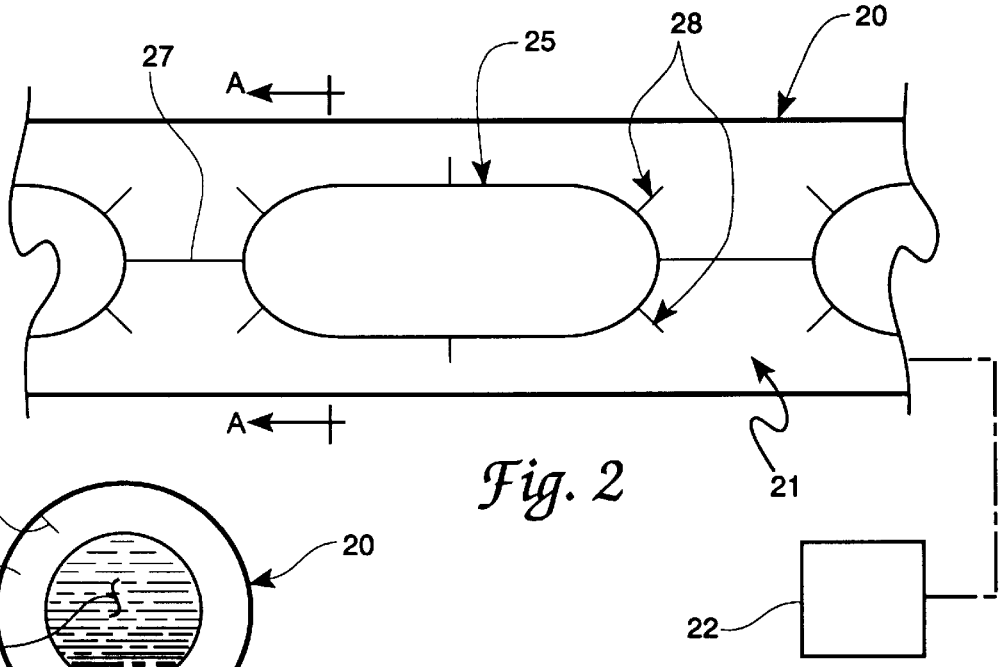
FIG. 2 illustrates a segment of plastic tubing having a pre-scored orifice in the wall of the tubing in accordance with a principal feature of the invention.
Figure 2A:
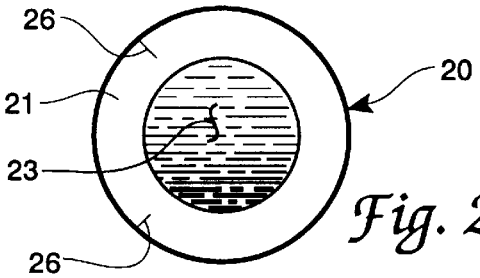
FIG. 2*a* is a view of the FIG. 2 tubing segment taken along line A—A.

Referring now to FIGS. 2 and 2*a*, shown therein are an illustration of a segment 20 of plastic tubing 21 and a cross-sectional view of tubing 21 structured in accordance with a representative embodiment of the invention. Tubing 21 (typically about 0.375 to 1.5 inches O.D. and about 0.03 to 0.0625 inch wall thickness), which, as suggested above, may be optionally connected to a suitable source 22 of extinguishant, is filled with a preselected extinguishant 23 under pressure. Tubing 21 may comprise any lightweight flexible plastic suitable for the purpose intended herein and as would occur to the skilled artisan guided by these teachings, including those plastic formulations taught by Stewart et al, supra, the same being incorporated here by reference. Extinguishant 23 may include any suitable liquid, gaseous, aerosol or foam generating formulations such as those taught by Stewart et al, and other commercially available extinguishants such as $CF_3I$ (mfg by Newhouse International, Inc.), and potassium lactate in water solution. Extinguishant 23 will typically be maintained at a pressure of about 1.2 to 10 atm, depending on extinguishant 23 selection.

In accordance with a governing principle of the invention, tubing 21 has a structure including a multiplicity of pre-scored, scribed, stamped, punched or otherwise formed orifice patterns 25 cut into the wall of tubing 21, the patterns 25 being spaced along the length (and/or around the circumference) of tubing 21 in any preselected arrangement, including non-uniform spacing, to allow placement of extinguishant discharge orifices at locations that provide optimum fire protection within the protected compartment within which the invention is used. With reference now particularly to FIG. 2*a*, it is seen that patterns 25 comprise regions defining cuts 26 into the wall thickness of tubing 21. Patterns 25 may have any suitable shape, such as circular, rectangular, the oval shape suggested in FIG. 2*a*, or other shape, as might be selected by the skilled artisan depending on the specific application in which the invention is used. The elongated oval pattern 25 shape illustrated may be preferred to optimize extinguishant flow rate for the physical constraints imposed by the outer surface shape of tube 21. Size of orifice patterns 25 will depend on the extinguishant 23 selection, tube 14 volume (and source 22 capacity if an additional source is connected to tubing 21), and anticipated extinguishant discharge rate and pressure needed for the particular application. Patterns 25 will typically have a dimension along a circumference of tubing 21 of about 0.75 to 1.5 times the diameter of tubing 21 and length of about 1 to 5 times the diameter. The cuts 26 in the tubing wall thickness that define patterns 25 will optimally be at a depth sufficient to ensure predictable rupture when a threshold of thermal loading is applied for a given wall thickness and tube extinguishant pressure, without premature discharge at thermal loadings and extinguishant pressures below a pre-set threshold. For most of the tubing 21 materials suggested above and useful extinguishant pressures, depth of scoring may optimally be about 0.1 to 0.25 times tubing 21 wall thickness. Additional scored line or cut segments 27, 28 along the length of tubing 21 or radiating from patterns 25 as suggested in FIG. 2 may also be included to ensure predictable rupture of tubing 21 and sufficient extinguishant discharge rates and durations when contacted by flame or heat, or to activate multiple orifices by interconnecting adjacent rupture patterns.

Figure 3:
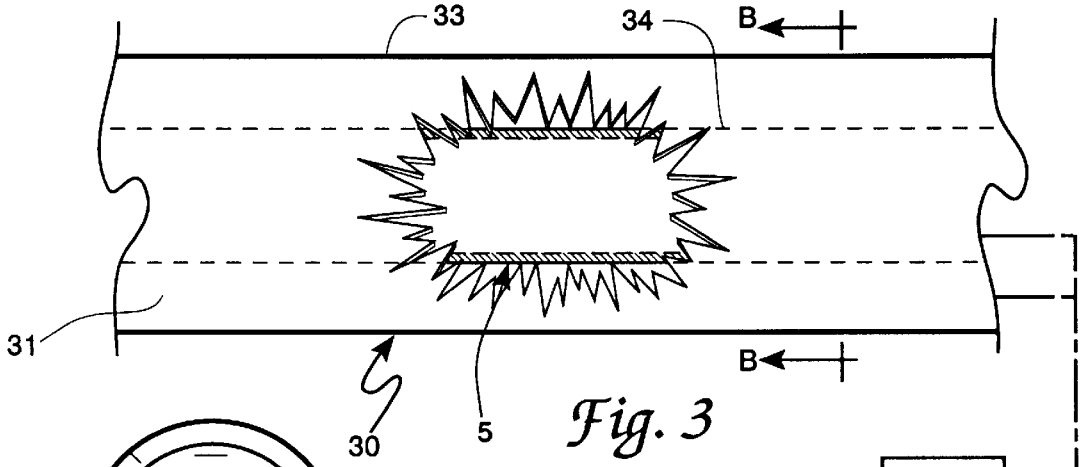
FIG. 3 illustrates a segment of the coaxial tubing structure according to the invention.
Figure 3A:
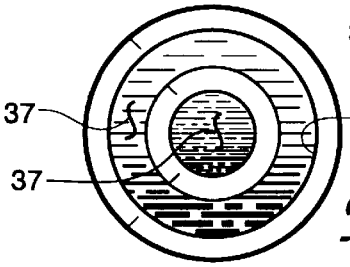
FIG. 3*a* is a view of the FIG. 3 tubing structure taken along line B—B.

Referring now to FIG. 3, shown therein is a view in partial cutaway of a segment 30 of the coaxial tubing structure 31 according to the invention, and FIG. 3*a* is a cross-sectional view of tubing structure 31 taken along line B—B. Tubing structure 31 according to the invention comprises an outer tube 33 and an inner tube 34 disposed coaxially with outer tube 33. Each tube 33,34 contains extinguishant and may be operatively connected to an optional pressurized source 36 of extinguishant, similarly to that described for tubing 21 of the FIG. 2,2*a* embodiment, in order to supply pressurized extinguishant 37 to the interior of inner tube 34 and to the region 38 defined between inner tube 34 and outer tube 33. Extinguishants described above as applicable to the FIG. 2,2*a* embodiments of the invention may be used in the FIG. 3,3*a* embodiment. Use of different extinguishants within tube 34 and region 38 is also contemplated by the invention. Tubes 33,34 may comprise any suitable material described above as suitable for tubing 21 of FIG. 2, and one or both of the tubes 33,34 (preferably at least the outer tube) may have the pre-scored orifice patterned structure described above for tubing 21 of FIG. 2. Outer tube 33 may ordinarily have an outer diameter in the range of about 0.5 to 1.5 inches, and wall thickness of about 0.03 to 0.0625 inch. Inner tube 34 will ordinarily have an outer diameter of about 0.375 to 0.75 inch, and wall thickness of about 0.03 to 0.0625 inch. Region 38 will optimally be about 0.0625 to 0.375 inch thick, in order to provide an extinguishant volume within inner tube 34 per unit length of tubing to be roughly 0.25 to 0.8 times the extinguishant volume per unit length within region 38.

In use, the coaxial tubing structure of FIGS. 3,3*a* as just described provides back-up fire extinguishing capability for a fire initially extinguished through the rupture of outer tube 33 and discharge of extinguishant 37 from region 38. If the fire is not extinguished with the discharged quantity of extinguishant 37 from region 38, or if the fire re-ignites after the extinguishant 37 from region 38 is exhausted, the fire will then impinge on and cause rupture of inner tube 34 with the consequent discharge of additional extinguishant from tube 34. Extinguishant contained in region 38 may also serve to substantially cool inner tube 34 until the extinguishant within region 38 is exhausted and inner tube 34 is exposed directly to the fire.

The entire teachings of all references cited herein are hereby incorporated by reference.

The invention therefore provides an improved linear fire extinguisher system. It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

I claim:

1. A linear fire extinguisher system, comprising:

(a) a first flexible, substantially closed plastic tube, said first tube defining an enclosed first volume therewithin;

(b) a second flexible, substantially closed plastic tube, larger in diameter than said first tube, said second tube disposed substantially coaxially around said first tube and defining an enclosed second volume therewithin and surrounding said first tube, said first and second tubes being configured for routing in serpentine fashion throughout a region to be protected from a fire;

(c) a first quantity of extinguishant disposed under pressure within said enclosed first volume, and a second quantity of extinguishant disposed under pressure within said second volume, whereby sufficient heat from a fire initially causes rupture of said second tube and discharge of said extinguishant from said second volume onto the fire, said first tube being available for subsequent rupture and discharge of extinguishant from said first volume upon contact of sufficient heat from the fire; and (d) a multiplicity of pre-scored orifice patterns defining selectively weakened sites in the wall of at least one of said first and second tubes at preselected spacing along the length of said at least one tube, whereby sufficient heat from a fire contacting said at least one tube will weaken and rupture said at least one tube preferentially and predictably at a said pattern and thereby facilitate efficient discharge of said extinguishant onto the fire.

2. The system of claim 1 further comprising a source of said extinguishant, and wherein said first and second tubes are operatively connected to said source.

3. The system of claim 1 wherein said extinguishant is a liquid, gas, aerosol or foam.

4. The system of claim 3 wherein said extinguishant is at a pressure of about 1.2 to 10 atm.

5. The system of claim 1 wherein the depth of scoring of said patterns is about 0.1 to 0.25 times the wall thickness of said at least one tube.

6. The system of claim 1 wherein said first volume is about 0.25 to 0.8 times said second volume per unit length of said first and second tubes.

* * * * *